US007117810B2

(12) United States Patent
Kristensen et al.

(10) Patent No.: US 7,117,810 B2
(45) Date of Patent: Oct. 10, 2006

(54) PLATFORM STRUCTURE

(75) Inventors: Per Herbert Kristensen, Rykkinn (NO); Ida Husem, Jar (NO); Erik Pettersen, Tranby (NO)

(73) Assignee: Moss Maritime AS, Lysaker (NO)

( * ) Notice: Subject to any disclaimer, the term of this patent is extended or adjusted under 35 U.S.C. 154(b) by 0 days.

(21) Appl. No.: 10/398,479

(22) PCT Filed: Oct. 2, 2001

(86) PCT No.: PCT/NO01/00403

§ 371 (c)(1),
(2), (4) Date: May 7, 2003

(87) PCT Pub. No.: WO02/28704

PCT Pub. Date: Apr. 11, 2002

(65) Prior Publication Data

US 2004/0040487 A1 Mar. 4, 2004

(30) Foreign Application Priority Data

Oct. 2, 2001 (NO) ..... 20005066

(51) Int. Cl.
*B63B 35/34* (2006.01)
*B63B 35/44* (2006.01)

(52) U.S. Cl. ..... 114/265; 405/195.1

(58) Field of Classification Search ..... 114/264–266, 114/122; 405/195.1, 200, 203, 205, 219, 405/223.1, 224
See application file for complete search history.

(56) References Cited

U.S. PATENT DOCUMENTS 2,892,435 A * 6/1959 Jungstrom ..... 114/122
2,973,046 A * 2/1961 McLean et al. ..... 175/8
3,163,147 A * 12/1964 Collipp ..... 114/265
3,224,401 A * 12/1965 Kobus ..... 114/265
3,241,324 A * 3/1966 Storm et al. ..... 405/196
3,246,476 A * 4/1966 Wolff ..... 405/207
3,273,526 A * 9/1966 Glosten ..... 114/265
3,391,666 A * 7/1968 Schuller ..... 114/122
3,415,067 A * 12/1968 Wolff ..... 405/207
3,490,406 A * 1/1970 O'Reilly et al. ..... 114/265
3,556,033 A * 1/1971 Bonnafous ..... 114/144 R
3,580,207 A * 5/1971 Pangalila ..... 114/144 B
3,673,973 A * 7/1972 Glosten ..... 114/265

(Continued)

FOREIGN PATENT DOCUMENTS

EP 124338 A1 * 11/1984

(Continued)

OTHER PUBLICATIONS

Internet article on "Metacentric Height", attributed to author Maxwell Mulholland, downloaded on Jun. 3, 2004 from www.gwpda.org/naval/gmdefn.htm.*

(Continued)

*Primary Examiner*—Ajay Vasudeva
(74) *Attorney, Agent, or Firm*—Birch, Stewart, Kolasch and Birch, LLP

(57) ABSTRACT

The invention relates to a floating platform (1) for offshore drilling or production of hydrocarbons, comprising a topsides (2) and a substructure (3) having a lower pontoon (4) and columns (5) connecting the pontoon (4) to the topsides (2). Heave motion ($s_1$, $s_2$) of the platform (1) causes a change in the metacentric height (GM) of the platform. To counteract this change in metacentric height, the columns (5) are so adapted that the moment of area inertia of the waterline area of the columns (5) decreases on downward heave motion ($s_1$) and increases on upward heave motion ($s_2$).

2 Claims, 4 Drawing Sheets

U.S. PATENT DOCUMENTS

| | | | | | |
|---|---|---|---|---|---|
| 3,771,481 | A | * | 11/1973 | Goren et al. | 114/265 |
| 3,797,438 | A | * | 3/1974 | Fayren | 114/77 R |
| 3,842,771 | A | * | 10/1974 | Murata | 114/61.31 |
| 3,911,687 | A | * | 10/1975 | Mo | 405/225 |
| 4,037,424 | A | * | 7/1977 | Anders | 405/207 |
| 4,043,138 | A | * | 8/1977 | Stageboe et al. | 405/205 |
| RE29,478 | E | * | 11/1977 | Goren et al. | 114/265 |
| 4,168,556 | A | * | 9/1979 | Fink et al. | 114/264 |
| 4,168,673 | A | * | 9/1979 | Poeppel | 114/265 |
| 4,443,131 | A | * | 4/1984 | Olsen | 405/203 |
| 4,452,165 | A | * | 6/1984 | Bergman | 114/125 |
| 4,487,150 | A | * | 12/1984 | Shanks | 114/264 |
| 4,556,008 | A | * | 12/1985 | Copson | 114/265 |
| 4,869,192 | A | * | 9/1989 | Pawolski | 114/265 |
| 4,987,846 | A | * | 1/1991 | Yamashita et al. | 114/265 |
| 6,139,224 | A | * | 10/2000 | Michel et al. | 405/224 |
| 2001/0026733 | A1 | * | 10/2001 | Ludwigson | 405/224.2 |

FOREIGN PATENT DOCUMENTS

| | | | | |
|---|---|---|---|---|
| EP | 0124338 | A1 | | 11/1984 |
| GB | 2292348 | A | * | 2/1996 |
| JP | 61139588 | A | * | 6/1986 |
| JP | 62-244789 | A | * | 10/1987 |

OTHER PUBLICATIONS

Internet posting "Fundamentals of Stability", download on Jun. 3, 2004 from www.fas.org/man/dod-101/navy/docs/swos/dca/stg4-01.html.*

"Field Development Concepts of the World: 4th Edition," Oilfield Publications Limited, Nov. 13, 2000, Herefordshire, England, pp. 110 &113.

"Sea Loads on Ships and Offshore Structures," Cambridge University Press, 1990, pp. 76-81.

* cited by examiner

PLATFORM STRUCTURE

This application is the national phase under 35 U.S.C. §371 of PCT International Application No. PCT/N001/00403 which has an International filing date of Oct. 2, 2001, which designated the United States of America.

The invention relates to a floating platform for offshore drilling or production of hydrocarbons, comprising a topsides equipped with drilling and/or production equipment, and a substructure comprising a lower pontoon and columns connecting the pontoon to the topsides, where the platform, when in service, is subjected to wave forces that cause heave motion and roll and pitch motion of the platform in the sea, where a heave motion of the platform causes a vertical displacement of the platform's centre of buoyancy, which in turn causes a change in the metacentric height of the platform.

Floating structures will undergo motion in the sea because of the waves. Waves in the sea are a very complex phenomenon, and the structure is subjected to waves from different directions and having different periods of oscillation. The floating structure undergoes both a drift motion, that is to say, a displacement of the structure, and an oscillatory motion. The oscillatory motion can be split into six components: linear reciprocating motion along three axes, that is to say, two horizontal directions and vertical direction, and rotational reciprocating motion about the same three axes. For a floating structure, it is usually three of the components of oscillatory motion that are of primary concern, namely vertical upward and downward motion, usually termed heave motion, rotational reciprocating motion about a horizontal longitudinal axis, usually termed roll motion, and rotational reciprocating motion about a horizontal transverse axis, usually termed pitch motion. The oscillatory motion generally occurs both at the excitation period of the waves and at natural periods of the structure for the different motion components, i.e., the structure's periods of oscillation for the different motion components if the structure is subjected to an excitation and is allowed to oscillate freely or only with a little damping.

Oscillations of floating structures are described in classical hydrodynamic theory, for example, in "Principles of Naval Architecture", published by the Society of Naval Architects and Marine Engineers in the USA.

A central concept in hydrodynamic theory is the metacenteric height, which is the vertical distance from the centre of gravity of the structure to its metacenter. The natural frequency of roll and pitch motion is dependent upon the metacentric height, as a structure having a great metacentric height undergoes sharp roll and pitch motion, whilst a structure having a small metacentric height undergoes slow roll and pitch motion.

On upward heave motion the structure displaces less water, and the centre of buoyancy is thus moved downwards in the structure. On downward heave motion the structure displaces more water, and the centre of buoyancy is thus moved upwards in the structure. The metacenter depends upon on the position of the centre of buoyancy, among other factors, and consequently is also moved downwards and upwards on upward and downward heave motion, respectively. However, the centre of gravity is independent of the structure's position and motion in the sea, and consequently, the metacentric height increases on downward heave motion, whilst it decreases on upward heave motion.

For a floating platform, it is desirable that its heave, roll and pitch motions are as small as possible and not too sharp. Because the roll and pitch motion depends upon the metacentric height, and because the metacentric height is altered during the heave motion, the roll and pitch motion is affected to a certain degree by the heave motion. If the roll and pitch motion has a natural period that is a whole multiple of the heave motion, the heave motion may intensify the roll and pitch motion. This phenomenon is called the Mathieu effect. For most floating structures, the Mathieu effect has little practical significance, but for some floating platforms it can be a problem. The Mathieu effect can also be observed in model tests, and proven by numerical calculations.

Accordingly, to reduce the roll and pitch motion of a floating platform it is advantageous to reduce the heave motion.

U.S. Pat. No. 3,986,471 describes a device for damping the heave motion of a semi-submersible vessel having a small waterline area, where the buoyancy is essentially provided by a pontoon. This document describes a damping plate having valves or similar flow controllers located in the sea, and which dampen the heave motion.

U.S. Pat. No. 4,934,870 describes a floating structure having limited heave motion. An elongated member has a lower end connected to the seabed, and an extensible tensioning means connected between a platform deck and the upper end of the elongated member. The tensioning means includes anti-heave force-exerting means.

These known structures reduce, but do not eliminate the heave motion. Consequently, the intensification of the roll and pitch motion because of the heave motion is reduced, but not eliminated.

To reduce, and preferably eliminate, the intensification of the roll and pitch motion because of the heave motion, it would be desirable to reduce or eliminate the actual functional impact of the heave motion on the roll and pitch motion.

The object of the invention is to provide a floating platform where the effect of the heave motion on the roll and pitch motion is reduced or eliminated.

The object is achieved with a floating platform of the type mentioned in the introduction that is characterized by the features that are disclosed in the claims.

SUMMARY OF THE INVENTION

Thus, the invention relates to a floating platform for offshore drilling or production of hydrocarbons, comprising a topsides equipped with drilling and/or production equipment, and a substructure comprising a lower pontoon and columns connecting the pontoon to the topsides, where the platform, when in service, is subjected to wave forces which cause heave motion and roll and pitch motion of the platform in the sea, where a heave motion of the platform causes a vertical displacement of the platform's centre of buoyancy, which in turn causes a change in the metacentric height of the platform. In the invention, portions of the columns in portions which are moved through the waterline during the motion of the platform in the sea are so adapted that the moment of area inertia with respect to a central axis of the columns decreases as distance from the pontoon increases, so that the moment of area inertia of the columns' waterline area increases on upward heave motion and decreases on downward heave motion. Furthermore, the columns are so adapted that the change in the moment of area inertia of the waterline area during heave motion essentially compensates for the change in metacentric height as a consequence of the displacement of the platform's centre of buoyancy.

The invention will now be described in more detail in connection with a specific embodiment, and with reference to the attached drawings, wherein:

DETAILED DESCRIPTION OF THE INVENTION

Figure 1:
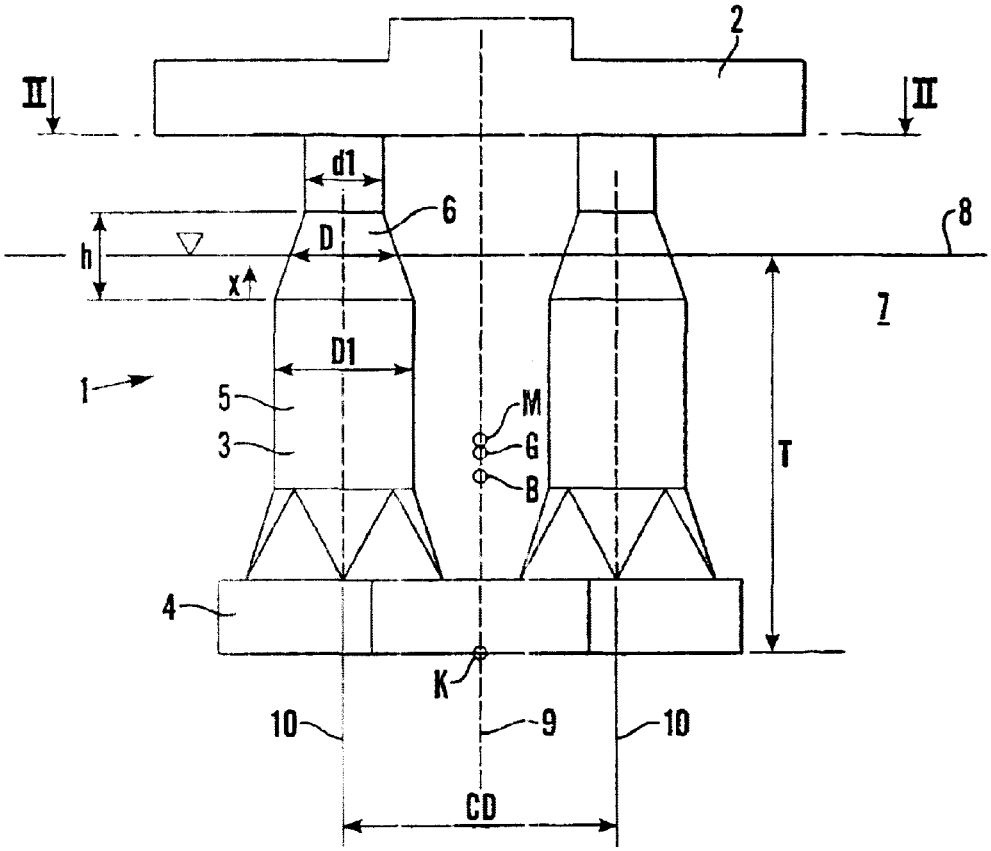
FIG. 1 is a side view of a floating platform according to the invention.

FIG. 1 shows an embodiment of a floating platform 1 according to the invention for offshore drilling or production of hydrocarbons, comprising a topsides 2 equipped with non-illustrated drilling and/or production equipment, and a substructure 3 which comprises a lower pontoon 4 and columns 5 connecting the pontoon 4 to the topsides 2. The platform 1 is in the sea 7, with the waterline indicated by means of the reference numeral 8. The topsides 2 may comprise one or more decks, and in addition to the drilling and/or production equipment may also comprise equipment and installations for carrying out a number of functions that are necessary in connection with a floating platform, for example, living quarters, hoisting cranes and electric generators. The columns 5 and the pontoon 4 are provided with non-illustrated buoyancy tanks and ballast water tanks which can be filled with water in order to adjust the position of the platform in the sea 7, and optionally storage tanks for hydrocarbons.

Figure 2:
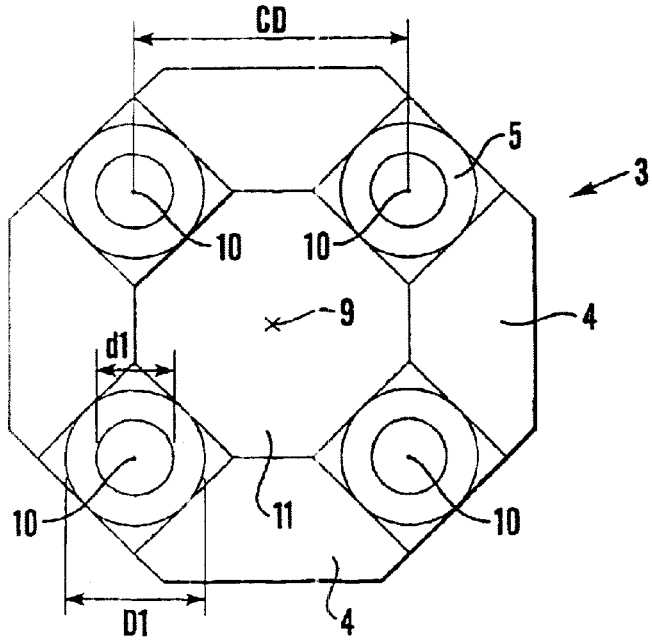
FIG. 2 is a cross-sectional top view of the platform in FIG. 1, taken along the line II—II.

FIG. 2 is a cross-sectional view through the platform 1, taken along the line II—II in FIG. 1. It can be seen that the pontoon 4 is octagonal, and has an octagonal opening 11 in the middle. It can also be seen that the columns 5 are four in number. Furthermore, from FIGS. 1 and 2 it can be seen that each column 5 has an axis 10, and that all the columns 5 have a common central axis 9. In FIGS. 1 and 2, the platform 1 is in a neutral position, that is to say, the position of the platform when it comes to rest in the sea without any external influences, and the axes 9 and 10 are vertical. The number of columns 5 and the shape of the pontoon 4 and topside 2 are partly chosen on the basis of requirements for sizing, and could have been different.

The platform 1 has a centre of gravity G, a centre of buoyancy B and a metacenter M. The middle of the underside of the pontoon 4, termed the midpoint of the keel, is indicated by the letter K. These points, together with the dimensions indicated in FIGS. 1 and 2, will be discussed in more detail below.

The platform may be of a type that is connected to the seabed by means of almost vertical tension legs, it may be connected to the seabed via slanting, slack moorings, or it may be held almost stationary in the sea by means of dynamic positioning, with the aid of thrusters that are controlled by an electronic control system. How the platform is moored or held stationary is beyond the scope of the invention, and is not shown in the figures.

Before a more detailed discussion of the invention, some considerations will be made concerning the motions of the platform in the sea.

When the floating platform 1 lies in the sea 7 it is subjected to pressure forces from the waves. Wave motion is a very complex phenomenon, and comprise waves having a number of different periods of oscillation that have an impact on the platform, so that it undergoes both a drift motion, that is to say, a displacement, and an oscillatory motion. The oscillatory motion can be split into six components: linear reciprocating motion along three axes, that is to say, the two horizontal directions and the vertical direction, and rotational reciprocating motion about the same three axes. For a floating platform, it is the roll and pitch motion, that is to say, the rotational reciprocating motion about the two horizontal axes, and the heave motion, that is to say, the vertical upward and downward motion, which are the primary motions of concern. The roll and pitch motion of the platform is indicated in FIG. 3 by the arrows $p_1$ and $p_2$, whilst the heave motion is indicated in FIG. 4 by the arrows $s_1$ and $s_2$.

Figure 3:
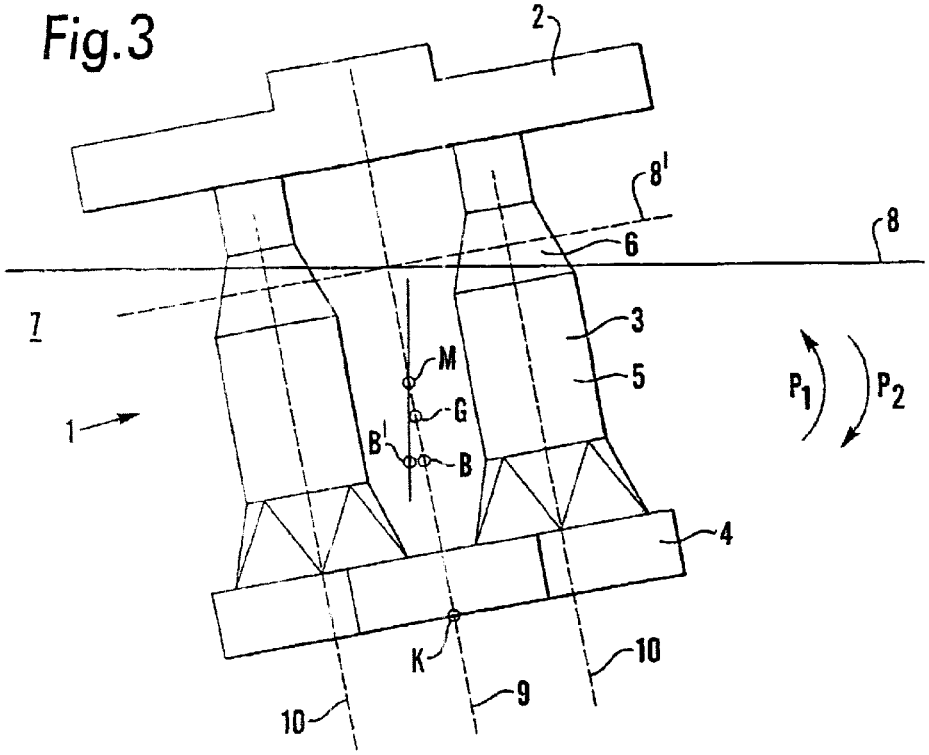
FIG. 3 shows the platform in FIG. 1 during a roll/pitch motion.

FIG. 3 shows the platform 1 during a roll/pitch motion, where the platform 1 has been turned in the direction $p_1$. The position of the waterline in the neutral position, seen in relation to the platform 1, is indicated by the reference numeral 8'. It can be seen that portions of the platform 1 to the right have moved up above the waterline 8, whilst portions of the platform to the left have moved down below the waterline. The platform's centre of buoyancy is the same as the centre of gravity of the water the platform displaces, and the centre of buoyancy, seen in relation to the platform 1, has therefore moved from the position B it had when the platform was in its neutral position in FIG. 1, to B'. A vertical line from the new centre of buoyancy B' intersects the central axis 9 of the columns in the metacentre M. This is the definition of metacenter. On a further turning of the platform in the direction $p_1$, the centre of buoyancy will move even more. However, the metacenter M will remain at almost the same point. The slight displacement of the metacenter that takes place upon a further turning of the platform 1 is negligible in connection with the invention.

Figure 4:
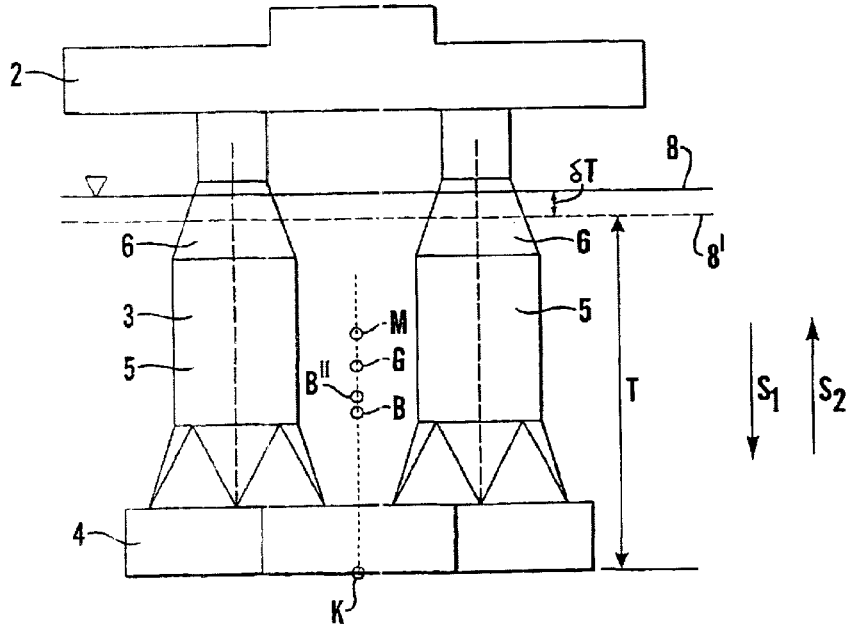
FIG. 4 shows the platform in FIG. 1 during a heave motion.

FIG. 4 shows the platform 1 during a heave motion, after it has moved from its neutral position in FIG. 1 downwards into the sea in the direction $s_1$, and the draught of the platform has increased from T to T+δT. The position of the waterline in the neutral position, seen in relation to the platform 1, is indicated by the reference numeral 8'. A part of the platform's columns 5 has moved down below the waterline 8, and consequently the platform 1 displaces a greater amount of water than it did in the position it had in FIG. 1. The platform's centre of buoyancy has therefore moved upwards from the position B to B", the platform 1 being used as reference.

However, the centre of gravity G of the platform is a function of the platform's mass and the distribution of the mass, both of which are constant and independent of the platform's buoyancy and position in the sea. Therefore, the centre of gravity G does not move during the heave motion.

From FIGS. 1, 3 and 4 it is apparent that it is only a certain portion of the columns 5, indicated by the reference numeral 6, which is moved through the waterline 8 during the motion of the platform 1 in the sea 7. In the portions 6, the columns 5 consist of straight truncated cones having a lower large diameter $D_1$ and upper small diameter $d_1$. The diameter in the waterline 8, between $D_1$ and $d_1$, varies with the variation of the waterline, and is indicated by the letter D. The distance between the centre lines of the truncated cones is designated CD, and is equal to the distance between the axes 10 of the columns. It can be seen that CD is constant.

Figure 5:
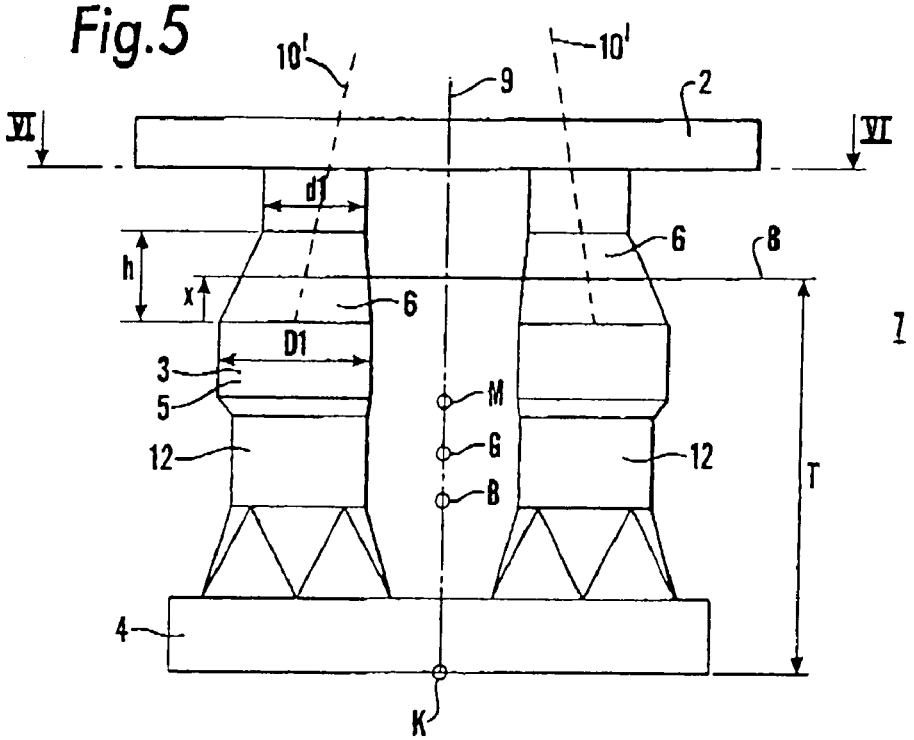
FIG. 5 is a side view of a second floating platform according to the invention.
Figure 6:
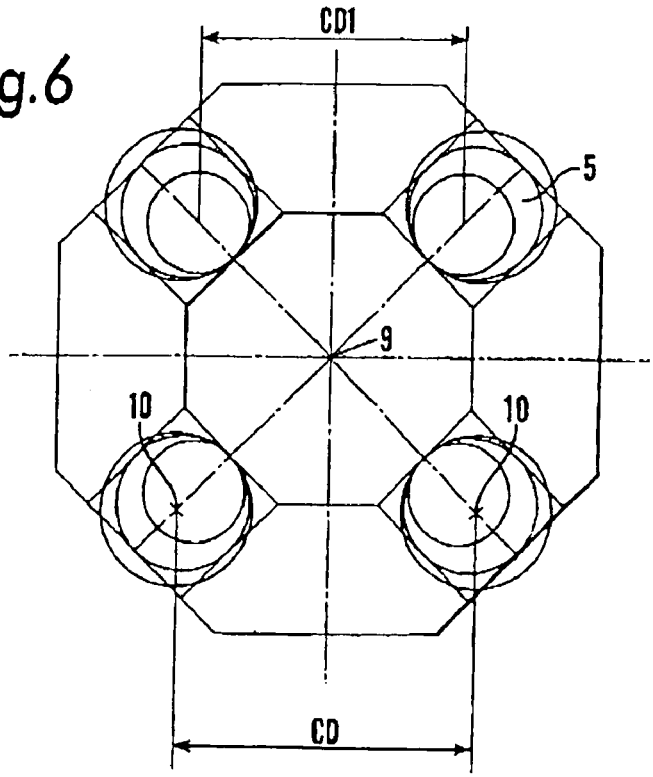
FIG. 6 is a cross-sectional top view of the platform in FIG. 5, taken along the line VI—VI.

FIG. 5 is a side view of a second embodiment of the floating platform according to the invention, whilst FIG. 6 is a top cross-sectional view through the platform in FIG. 5, taken along the line VI—VI. From FIGS. 5 and 6 it can be seen that the portions 6 of the columns which upon the motion of the platform in the sea 7 are moved through the waterline 8 are designed as oblique, truncated columns, which are straight on the sides facing the central axis 9. As a result, the distance CD varies between the centre lines of the cones along the cones, and has the value $CD_1$ at the small diameter of the cones. Furthermore, FIGS. 5 and 6 show columns that have constrictions 12 some distance below the waterline 8. These are provided for constructive reasons which do not relate to the invention. In other respects, the embodiment of the platform according to the invention shown in FIGS. 5 and 6 is identical to the embodiment shown in FIGS. 1–4.

From FIGS. 1, 3, 4 and 5 the following, general relation between the metacenter M, the centre of gravity G, the centre of buoyancy B and the midpoint of the keel K can be seen:

$$GM+KG=KB+BM$$

where GM, which is termed the metacentric height, is the distance between the centre of gravity and the metacenter, KG is the distance between the midpoint of the keel and the centre of gravity, KB is the distance between the midpoint of the keel and the centre of buoyancy and BM is the distance between the centre of buoyancy and the metacenter.

A rewriting of the above expression to express the metacentric height gives:

$$GM=KB+BM-KG$$

The metacentric height is an important parameter for the natural frequency of roll and pitch motion, as a structure with a great metacentric height undergoes sharp roll and pitch motion, whilst a structure with a small metacentric height undergoes slow roll and pitch motion.

From FIGS. 1 and 4 it can be seen that the platform 1 in its neutral position has a draught T, which on the downward heave motion, see FIG. 4, increases by δT. The heave motion causes a change of GM that is termed δGM(δT). Using the above equation, this can be expressed as:

$$\delta GM(\delta T)=\delta KB(\delta T)+\delta BM(\delta T)-\delta KG(\delta T)$$

However, neither the midpoint of the keel K nor the platform's centre of gravity G will move on a motion of the platform Consequently, KG is constant and δKG=0. This means that $$\delta GM(\delta T)=\delta KB(\delta T)+\delta BM(\delta T)$$

As a consequence of the fact that the roll and pitch motion is dependent upon the metacentric height, the roll and pitch motion is affected by this change in the metacentric height. When the heave motion wholly or partly varies concurrently with the roll and pitch motion, this change in the metacentric height may intensify the roll and pitch motion. This phenomenon is called the Mathieu effect.

To eliminate the effect of the heave motion on the roll and pitch motion, i.e., to eliminate the Mathieu effect, it is imperative that δGM(δT)=0, that is $$\delta KB(\delta T)=-\delta BM(\delta T)$$

This must be fulfilled for portions 6 of the columns 5 which are moved through the waterline 8 during the motion of the platform 1 in the sea 7.

To find an expression for KB(δT), reference is made to FIG. 4, where the draught T of the platform has been increased by δT. An equilibrium of moment about the midpoint K of the keel gives the following expression for the distance between the midpoint K of the keel and the new centre of buoyancy B:

$$KB(\delta T):=\frac{\Delta\cdot KB_0+A_w\cdot\delta T\cdot\left(T+\frac{\delta T}{2}\right)}{\Delta+A_w\cdot\delta T}$$

where $KB_0$ signifies the distance from the midpoint K of the keel to the centre of buoyancy $B_0$ at original draught T, $A_w$=the waterline area=$\pi*(D^2/4)*4$, Δ is volume displacement and $A_w\delta T$ is the increment to the volume displacement as a consequence of the increase of the draught by δT.

A derivation of this expression gives:

$$\frac{d}{d\delta T}KB(\delta T)\rightarrow\frac{\left[A_w\cdot\left(T+\frac{1}{2}\cdot\delta T\right)+\frac{1}{2}\cdot A_w\cdot\delta T\right]}{(\Delta+A_w\cdot\delta T)}-\frac{\left[\Delta\cdot KB_0+A_w\cdot\delta T\cdot\left(T+\frac{1}{2}\cdot\delta T\right)\right]}{(\Delta+A_w\cdot\delta T)^2}\cdot A_w$$

Hydrodynamic theory is used to find an expression for BM(δT), saying that $$BM=I_{wl}/\nabla$$

where $I_{wl}$ is the moment of area inertia of the waterline area and ∇ is the volume displacement.

The moment of area inertia of the waterline area can be written:

$$I=\pi*(D^4/64)*n+\pi(D^2/4)*(CD/2)^2*n$$

where D is the diameter of the truncated cones in the waterline 8, n is the number of columns and CD is the distance between the centre lines of the truncated cones. For the embodiment of the invention shown in FIGS. 1–4, CD is constant and equal to the distance between the axes 10 of the columns, see FIG. 2. For the embodiment of the invention shown in FIGS. 5 and 6, the distance CD between the centre lines of the cones varies along the cones, and has the value $CD_1$ at the upper small diameter of the cones. In both embodiments D varies as mentioned from the lower large diameter $D_1$ to the upper small diameter $d_1$.

A partial derivation of the moment of area inertia with recpect to D and CD gives:

$$\delta I=\pi/4*((4*D^3/4*\delta D)+2*D*CD^2*\delta D+D^2*CD*2*\delta CD)$$

$$\delta I=\pi/4*((D^3+2*D*CD^2)*\delta D+2*D^2*CD*\delta CD)$$

From FIG. 5 it is apparent that x indicates the height of the waterline 8 above the bottom of the cone having the large diameter $D_1$. This gives the following expression for the diameter at any height:

$$D(x,\ d_1)=D_1-(D_1-d_1)*x/h$$

$$\delta D(x,\ d_1)=-(D_1-d_1)/h*\delta x$$

where h is the height of the conical portion of the columns.

Similarly, the distance CD between the centre lines of the cones may be written:

$$CD(x,d_1)=CD-(D_1-d_1)*1/\sqrt{2}*x/h$$

$$\delta CD(x,d_1)=-(D-d_1)/(\sqrt{2}*h)*\delta x$$

Furthermore, δT=δx By substituting the above in the expression for BM, it is possible to write the whole variation equation for BM:

$$\delta BM(x, d1) := \frac{\left(\frac{\pi}{4}\cdot\left[(D(x, d1)^3 + 2\cdot D(x, d1)\cdot CD(x, d1)^2)\cdot\frac{-(D1-d1)}{n} + 2\cdot D(x, d1)^2\cdot CD(x, d1)\cdot\frac{-(D1-d1)}{\sqrt{2}\cdot h}\right]\right)}{(\Delta)}\cdot\delta T$$

x is most expediently assumed to be equal to h/2 so as to allow the heave motion up and down to act on an equally large part of the column portions having the shape of truncated cones.

By assuming that δBM and δKB from the above expressions are equal to one another with the sign reversed and solving these equations as regards $d_1$, we can find the dimensions that fulfil the requirement that the variation of GM should be equal to 0. The equations are not easy to solve explicitly. However, the equations can be solved numerically, for example, by using the computer program Mathcad, where the expression can be solved numerically by a method for solving non-linear equations. Mathcad has been developed by Mathsoft in the USA and is available from the Internet, at www.mathsoft.com.

With the embodiment of the invention shown in FIGS. 1–4, substituting the values $D_1$=25m, CD is constant=48m, n=4 and h=15m will give the solution to the equations that $d_1$=15.0m. This corresponds to a cone angle of about 71°. With the embodiment of the invention shown in FIGS. 5 and 6, substituting the values $D_1$=25m, CD=50.1m at the lower large diameter of the cone and decreases to $CD_1$=44m at the upper small diameter of the cone, n=4 and h=15m will give the solution to the equations that $d_1$=16.4m. This corresponds to a cone angle of about 60°. The values for $d_1$ and the cone angle will, of course, change when the substituted dimensions are of other values.

Reference will again be made to the formula for the moment of area inertia of the waterline area:

$$I=\pi*(D^4/64)*n+\pi(D^2/4)*(CD/2)^2*n$$

where D is the diameter of the truncated cones in the waterline 8, n is the number of columns and CD is the distance between the centre lines of the truncated cones.

By providing the portions of the columns that move through the waterline with conical portions, it is ensured that the moment of area inertia of the waterline area of the column with respect to the central axis 9 of the columns increases when the platform moves upwards, and decreases when the platform moves downwards. In this way, the dynamic variation of the metacentric height that is due to the displacement of the centre of buoyancy on heave motion, and which is the origin of the Mathieu effect, is counteracted.

To gain an understanding of the values that contribute to the moment of area inertia of the waterline area, typical values are substituted for n, CD and D at the middle of the columns, where the waterline is located when the platform is in its neutral position. The substitution of n=4, CD=44m and D=15m gives the following value for the moment of area inertia of the waterline area:

$$I=9.9*10^3+2.5*10^5=2.6*10^5 m^4$$

Figure 7:
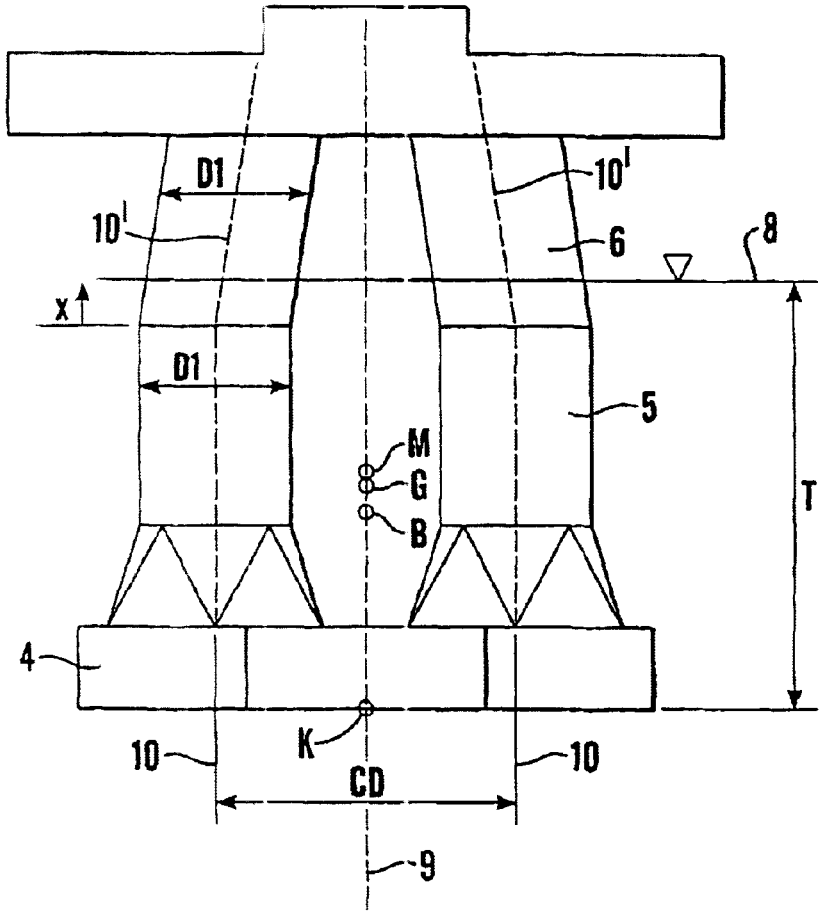
FIG. 7 is a side view of another floating platform according to the invention.

The second term, which includes the distance CD between the centre lines of the cones, is far greater than the first term, which only includes the diameter and number of the columns. Thus, this example shows that the change in distance between the centre lines of the cones in the portion that moves through the waterline contributes far more to the change in the moment of area inertia than the change in the diameter of the columns. Thus, the invention could also be realised with the embodiment shown in FIG. 7, where the columns 5 in the portions 6 which are moved through the waterline during the motion of the platform in the sea have constant diameter $D_1$ and axes 10' which are inclined towards the central axis 9 of the columns, the distances between the axes 10' of the columns and the central axis 9 of the column decreasing as the distance from the pontoon 4 increases. In other respects, the embodiment of the invention illustrated in FIG. 7 is similar to the embodiment shown in FIGS. 1–4.

In the above a mathematical description of the invention is given. From the above, it can be seen that the invention can also be disclosed in that the columns 5 in the portions 6 which are moved through the waterline 8 during the motion of the platform 1 in the sea 7 are so adapted that the moment of area inertia with respect to a central axis 9 of the columns decreases as the distance from the pontoon 4 increases, so that the moment of area inertia of the waterline area of the columns decreases on downward heave motion in the direction s, and increases on upward heave motion in the direction $S_2$. Furthermore, the columns 5 are so adapted that the change in the moment of area inertia of the waterline area on heave motion $s_1$, $s_2$ produces a change in the metacentric height that is oppositely equal to the change in metacentric height as a consequence of the displacement of the platform's centre of buoyancy B.

In the above mathematical analysis, the terms for δKB and δBM are assumed to be oppositely equal to one another, which provides a floating platform where the effect of the heave motion on the roll and pitch motion is completely eliminated. However, it will be appreciated from the above that the invention could also be used only to reduce, and not completely eliminate, the effect of the heave motion on the roll and pitch motion. This may be desirable in cases where a complete elimination of the effect of the heave motion on the roll and pitch motion is not necessary, and other constructive or economical considerations call for a constructive design that deviates from the design which completely eliminates the effect of the heave motion on the roll and pitch motion. In such cases, the terms for δKB and δBM will only be almost oppositely equal to one another, and the columns 5 will be so adapted that the change in the moment of area inertia of the waterline area on heave motion will mostly compensate for the change in the metacentric height GM as a consequence of the displacement of the platform's centre of buoyancy B.

The invention claimed is:

1. A floating platform (1) for offshore drilling or production of hydrocarbons, comprising a topsides (2) equipped with drilling and/or production equipment, and a substructure (3) comprising a lower pontoon (4) and columns (5) connecting the pontoon (4) to the topsides (2), where the platform (1), when in service, is subjected to wave forces which cause heave motion (s1, s2) and roll and pitch motion ($p_1$, $p_2$) of the platform (1) in the sea (7), where a heave motion (s1, s2) of the platform (1) causes a vertical displacement of the platform's center of buoyancy (B) which in turn causes a change in the metacentric height (GM) of the platform, that the columns (5) in portions (6) which are moved through the waterline (8) during the motion of the platform (1) in the sea (7) are so adapted that the moment of area inertia with respect to a central axis (9) of the columns decreases as the distance from the pontoon (4) increases, so that the moment of area inertia of the waterline area of the columns decreases upon downward heave motion ($s_1$) and increases on upward heave motion ($s_2$), wherein the columns (5) are so adapted that the change in the moment of area inertia of the waterline area on heave motion ($s_1$, $s_2$) essentially compensates for the change in the metacentric height (GM) as a consequence of the displacement of the centre of buoyancy (B) of the platform, by the platform designed in accordance with the criteria $$GM + KG = KB + BM$$

where GM, the metacentric height, is the distance between the centre of gravity and the metacenter, KG is the distance between the midpoint of the keel and the centre of gravity, KB is the distance between the midpoint of the keel and the centre of buoyancy and BM is the distance between the centre of buoyancy and the metacenter, where the platform has a draught T, which on heave motion increases by +/−δT, and where to minimize or eliminate the effect of the heave motion on the roll and pitch motion, δGM(δT) must be equal or close to zero, which gives that $$\delta KB(\delta T) \approx \delta BM(\delta T),$$

wherein the columns (5) are so adapted that the change in the moment of area inertia of the waterline area upon a heave motion ($s_1$, $s_2$) produces a change in the metacentric height that is oppositely equal to the change in metacentric height as a consequence of the displacement of the platform's centre of buoyancy (B), and wherein the columns (5) in the portions (6) which are moved through the waterline (8) during the motion of the platform in the sea (7) have the shape of truncated cones with the narrow end pointing upwards.

2. A floating platform according to claim 1, wherein the columns (5) in the portions (6) which are moved through the waterline during the motion of the platform in the sea (7) have axes (10') that are inclined towards the central axis (9) of the columns, the distances between the axes (10') of the columns in these portions (6) and the central axis (9) of the columns decreasing as the distance from the pontoon (4) increases.

* * * * *

UNITED STATES PATENT AND TRADEMARK OFFICE

CERTIFICATE OF CORRECTION

PATENT NO. : 7,117,810 B2
APPLICATION NO. : 10/398479
DATED : October 10, 2006
INVENTOR(S) : Per Herbert Kristensen et al.

It is certified that error appears in the above-identified patent and that said Letters Patent is hereby corrected as shown below:

Title Page, Item (30) should read:

(30) Foreign Application Priority Data

Oct. 6, 2000 (NO) …….20005066

Signed and Sealed this

Sixth Day of March, 2007

JON W. DUDAS
*Director of the United States Patent and Trademark Office*